US012605002B2

(12) United States Patent
Bynum

(10) Patent No.: US 12,605,002 B2
(45) Date of Patent: Apr. 21, 2026

(54) TABLE COVER ASSEMBLY

(71) Applicant: Andre Bynum, Milwaukee, WI (US)

(72) Inventor: Andre Bynum, Milwaukee, WI (US)

( * ) Notice: Subject to any disclaimer, the term of this patent is extended or adjusted under 35 U.S.C. 154(b) by 0 days.

(21) Appl. No.: 18/403,873

(22) Filed: Jan. 4, 2024

(65) Prior Publication Data

US 2025/0221556 A1 Jul. 10, 2025

(51) Int. Cl.
*A47G 23/00* (2006.01)
*A47G 23/08* (2006.01)

(52) U.S. Cl.
CPC ..... *A47G 23/00* (2013.01); *A47G 23/08* (2013.01)

(58) Field of Classification Search
CPC ..... A47G 23/00; A47G 23/08; A47G 23/06; A47G 23/14; A47G 23/16
USPC ..... 248/694; 108/50.11, 90; 312/213, 284; 135/124
See application file for complete search history.

(56) References Cited

U.S. PATENT DOCUMENTS 623,445 A * 4/1899 Van Tuyl ..... E04H 15/003 135/96
814,473 A * 3/1906 Patterson ..... E04H 15/02 135/96
1,411,272 A * 4/1922 Eaton ..... A47B 71/00 312/258
1,437,219 A * 11/1922 Berthon ..... A47G 19/26 135/132
2,367,043 A * 1/1945 Nelson ..... A47C 29/006 135/120.3
3,227,283 A * 1/1966 Ahlman ..... A47F 5/02 211/163
3,294,244 A * 12/1966 Laughlin ..... A47G 23/0316 211/41.1
3,413,820 A * 12/1968 Paquin ..... A47G 23/04 220/574.3
3,515,304 A * 6/1970 Bliss ..... A47G 23/08 312/285
4,117,627 A * 10/1978 Slingerland, Jr. ..... A47G 7/041 108/103
4,549,714 A * 10/1985 Busch ..... A47G 23/08 248/349.1
4,685,483 A * 8/1987 Balazs ..... A47G 19/26 211/180
4,708,183 A * 11/1987 Figueroa ..... F16B 2/12 248/231.71
4,822,118 A * 4/1989 Watkins ..... B44D 3/04 312/305

(Continued)

FOREIGN PATENT DOCUMENTS

WO WO9945822 9/1999

*Primary Examiner* — Nkeisha Smith

(57) ABSTRACT

A table cover assembly for enclosing items over a table to protect the items from pests or other environmental hazards includes a base and a canopy. The canopy defines a cavity and is removably positionable atop the base in a covering position wherein the base covers an opening to the cavity. The canopy defines a plurality of access openings which extend through the canopy to the cavity. A plurality of doors is mounted to the canopy. Each door is movable to access the cavity from outside the canopy through at least one of the plurality of access openings of the canopy. The canopy may be rigid and may support a track for slidably moving the doors over any of the access openings. A turntable is provided for moving the items closer to a user.

19 Claims, 6 Drawing Sheets

(56) References Cited

U.S. PATENT DOCUMENTS 5,078,096 A * 1/1992 Bishop ..... E04H 15/40 119/497
5,171,077 A * 12/1992 Jondahl ..... A47F 3/10 312/324
5,311,813 A * 5/1994 Fairbanks ..... A47J 47/005 135/96
5,727,857 A * 3/1998 Smith ..... A47F 3/0404 312/351.3
5,832,943 A * 11/1998 Johnson ..... E04H 15/36 D21/837
D437,096 S 1/2001 Julien
6,499,411 B2 * 12/2002 Brown ..... E04H 15/02 108/26
6,644,329 B2 * 11/2003 Tomason ..... E04H 15/02 135/96
6,668,579 B1 * 12/2003 Bigwood ..... A01K 7/005 62/457.2
7,383,836 B2 * 6/2008 Klemming ..... F24B 1/181 126/190
7,712,437 B2 * 5/2010 Leung ..... A01K 1/0245 119/482
8,132,585 B2 * 3/2012 Rothweil ..... A45F 3/52 135/117
8,899,253 B1 * 12/2014 Watson ..... E04H 15/40 135/913
9,388,600 B2 * 7/2016 Leathers ..... A47B 97/00
10,551,014 B2 * 2/2020 Selevan ..... H02J 7/00034
11,827,457 B2 * 11/2023 Du Bois ..... A47G 19/08
11,840,375 B2 * 12/2023 Ivory ..... A47G 19/26
12,196,358 B2 * 1/2025 Che ..... F16C 19/06
2002/0036203 A1 * 3/2002 Stewart ..... B65D 33/02 220/252
2003/0106471 A1 * 6/2003 Rivers ..... A47B 13/08 108/90
2005/0076814 A1 * 4/2005 Madden ..... A47G 23/0303 108/44
2008/0000398 A1 1/2008 Barkley
2008/0216882 A1 * 9/2008 Gillespie ..... A47F 10/02 135/96
2010/0163695 A1 * 7/2010 Mills, Sr. ..... A47G 19/10 248/154

* cited by examiner

TABLE COVER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to table covers and more particularly pertains to a new table cover for enclosing items over a table to protect the items from pests or other environmental hazards.

(2) Description of Related Art Including Information Disclosed Under 37 CFR 1.97 and 1.98

Various table covers are known to the prior art which cover items placed over a table to prevent pests, precipitation, or other hazards from interfering with food or other objects. Such apparatuses typically have flaps or doors for accessing the items while remaining covered. However, the prior art fails to disclose an apparatus which has a rigid canopy with doors slidably mounted so that the doors can move around the canopy and selectively cover access openings. The prior art also fails to describe such an apparatus which includes a turntable style member to facilitate access to items covered by the canopy by rotating the turntable and accessing the items via a nearest access opening in the canopy.

BRIEF SUMMARY OF THE INVENTION

An embodiment of the disclosure meets the needs presented above by generally comprising a base and a canopy. The canopy defines a cavity and is removably positionable atop the base in a covering position wherein the base covers an opening to the cavity. The canopy defines a plurality of access openings which extend through the canopy to the cavity. A plurality of doors is mounted to the canopy. Each door is movable to access the cavity from outside the canopy through at least one of the plurality of access openings of the canopy.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
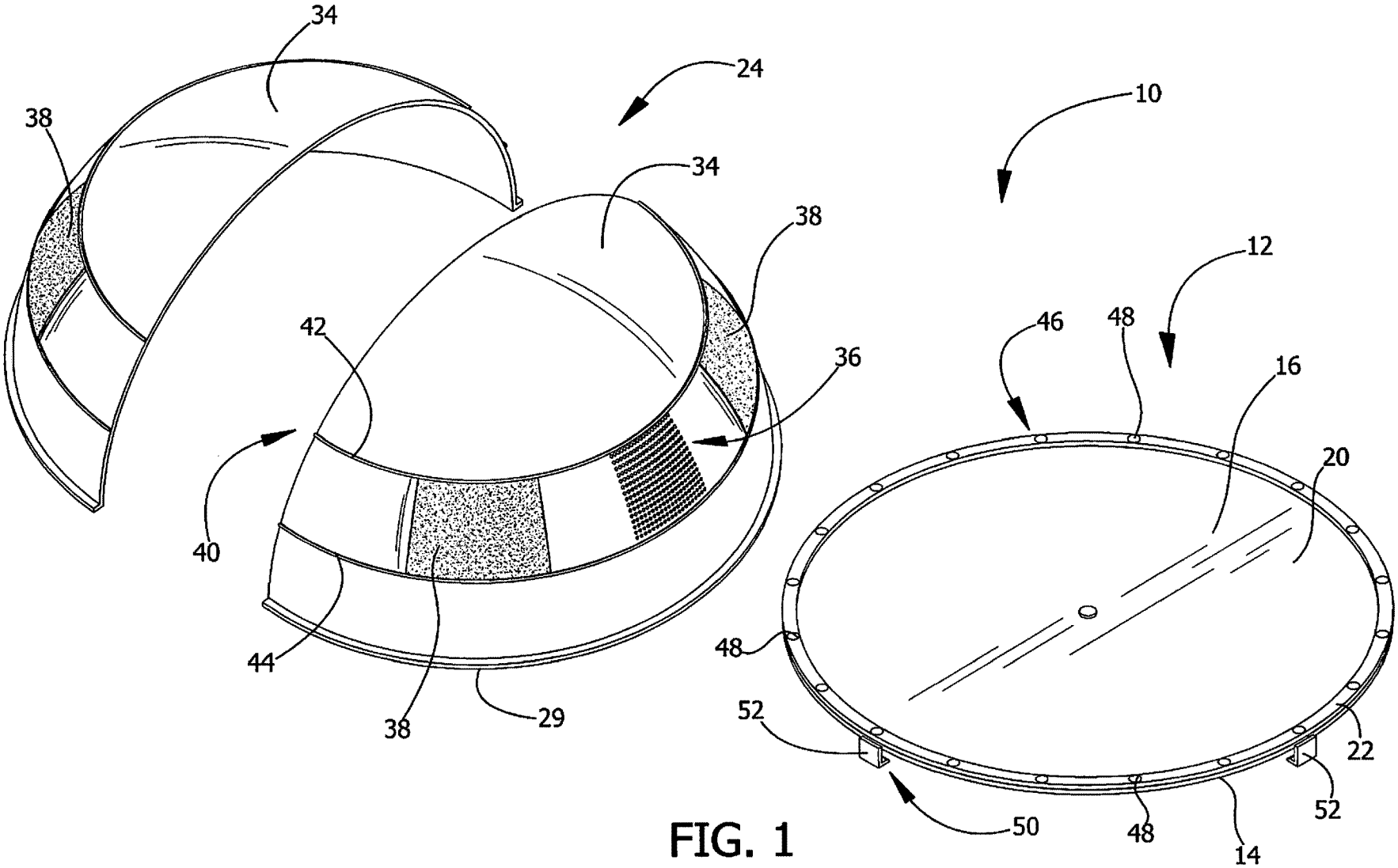
FIG. 1 is a perspective kit view of a table cover assembly according to an embodiment of the disclosure.
Figure 2:
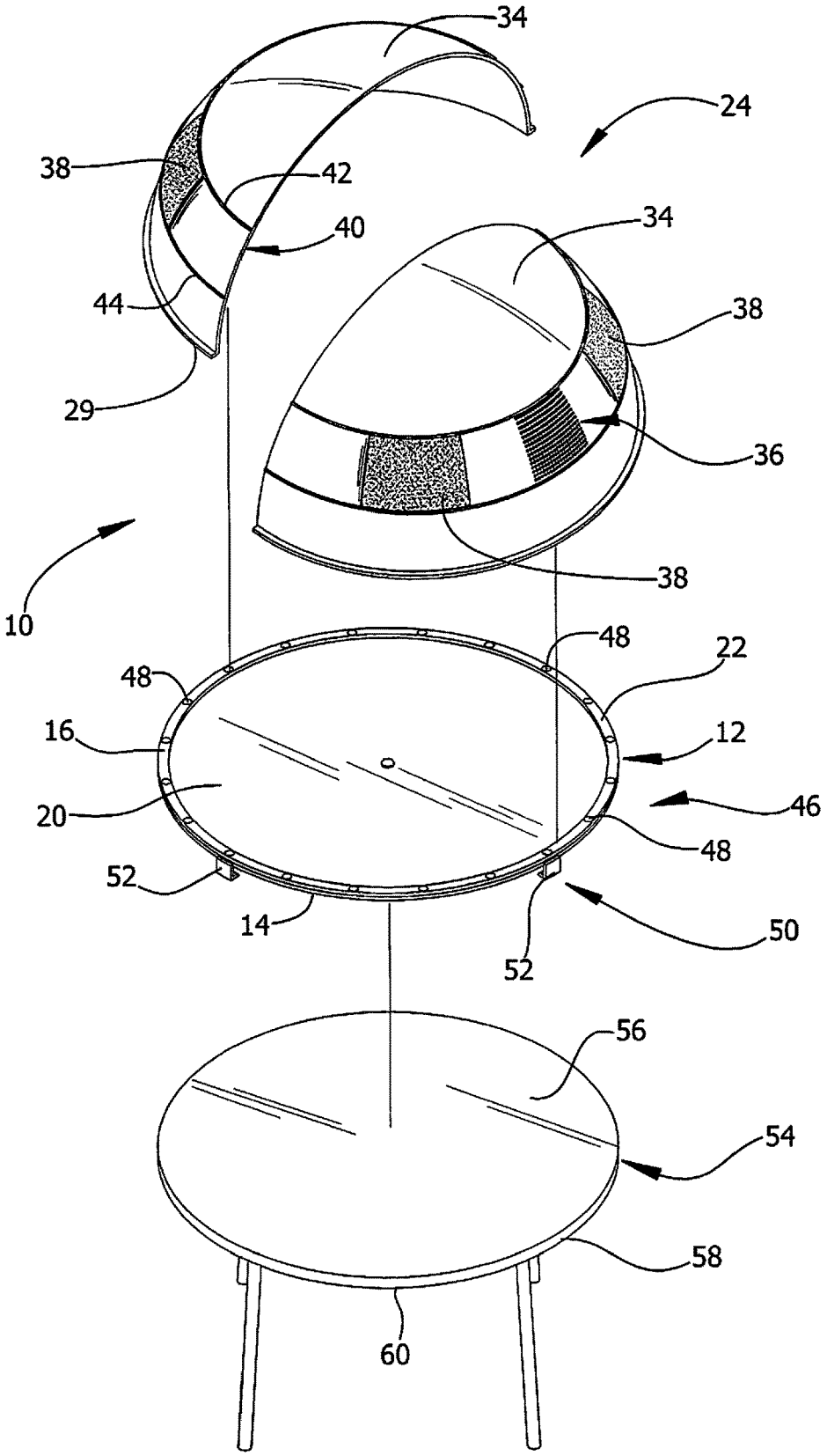
FIG. 2 is a perspective exploded in-use view of an embodiment of the disclosure.
Figure 3:
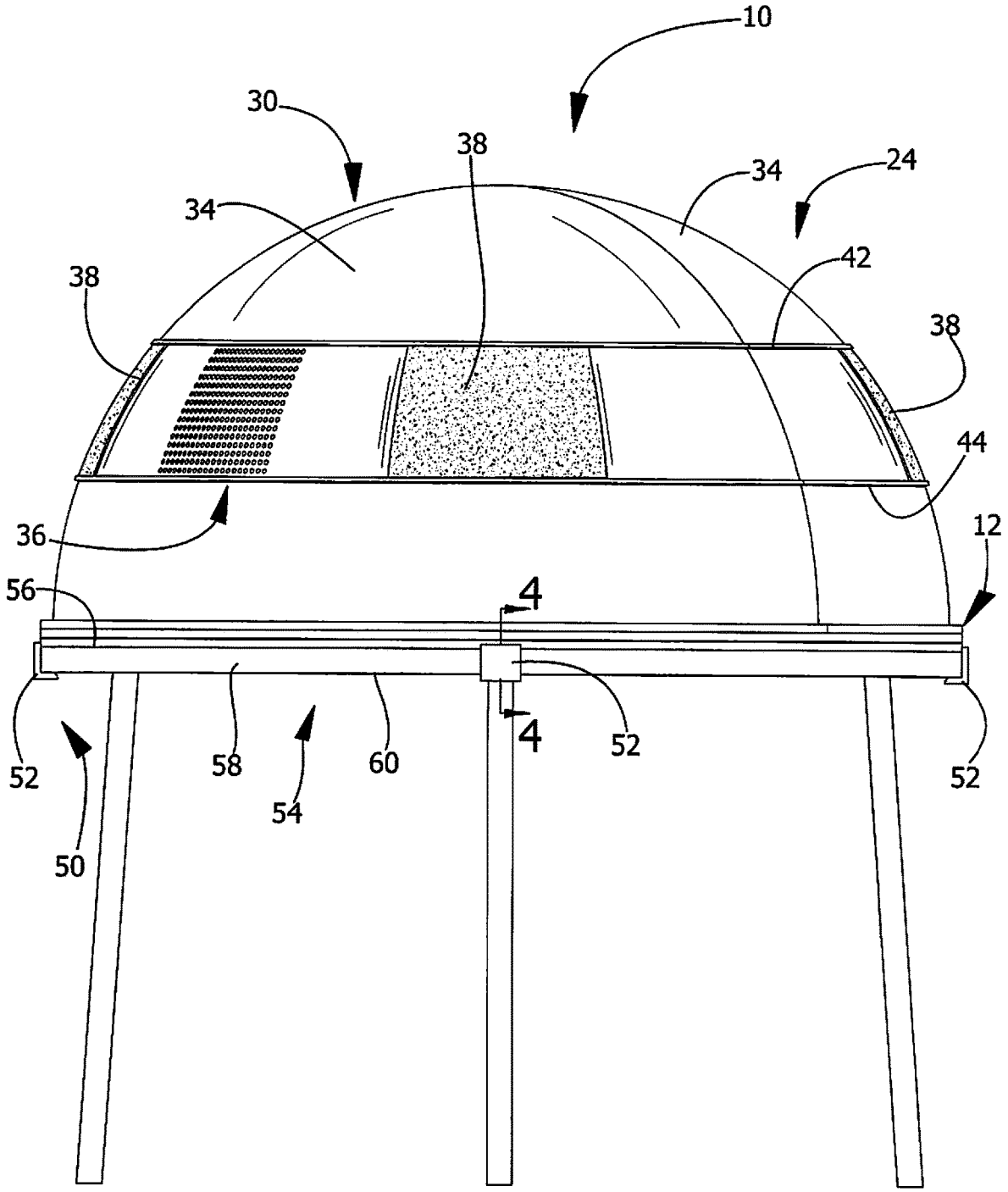
FIG. 3 is a front in-use view of an embodiment of the disclosure.
Figure 4:
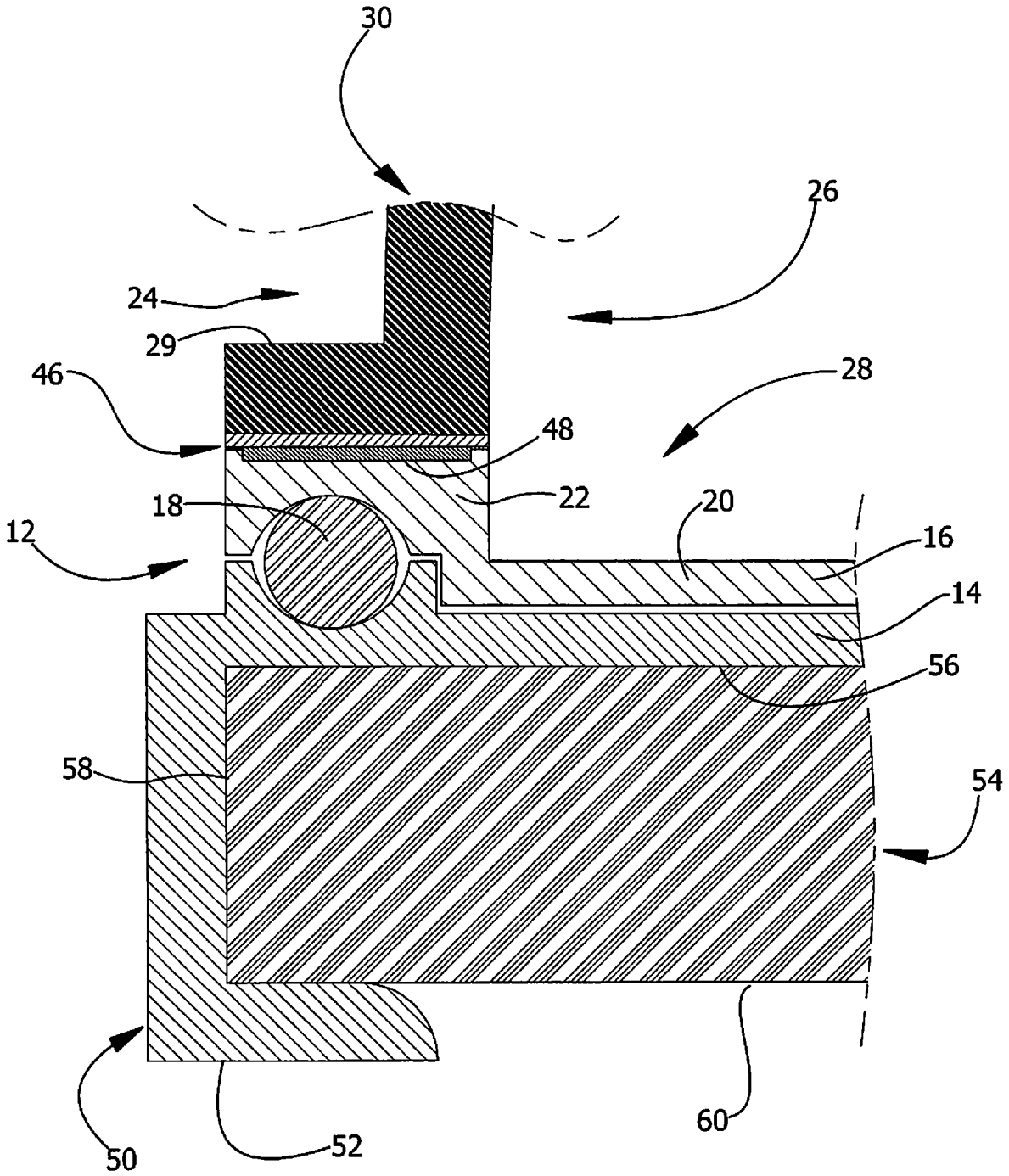
FIG. 4 is a cross-section view of an embodiment of the disclosure taken from Line 4-4 in FIG. 3.
Figure 5:
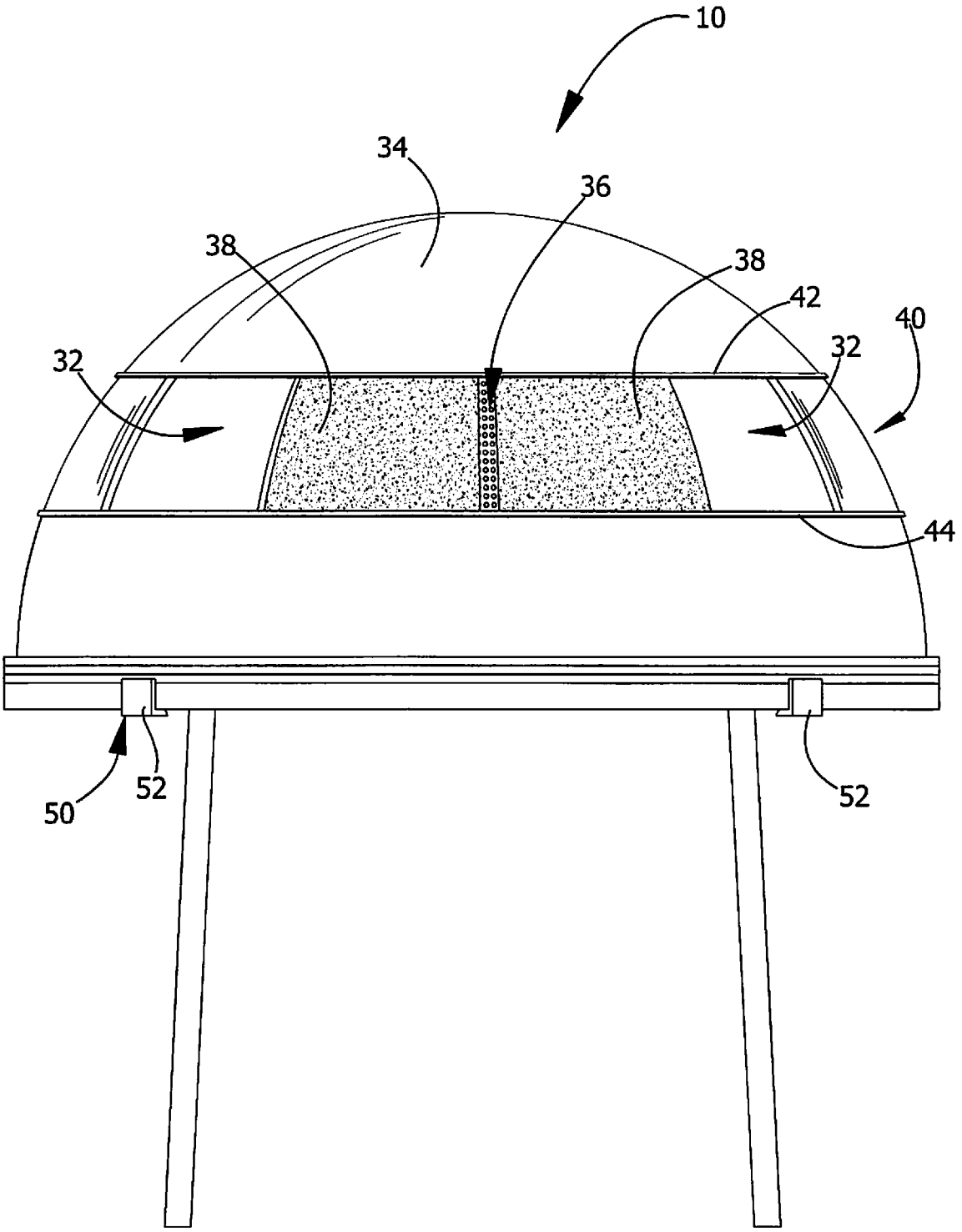
FIG. 5 is a side in-use view of an embodiment of the disclosure.
Figure 6:
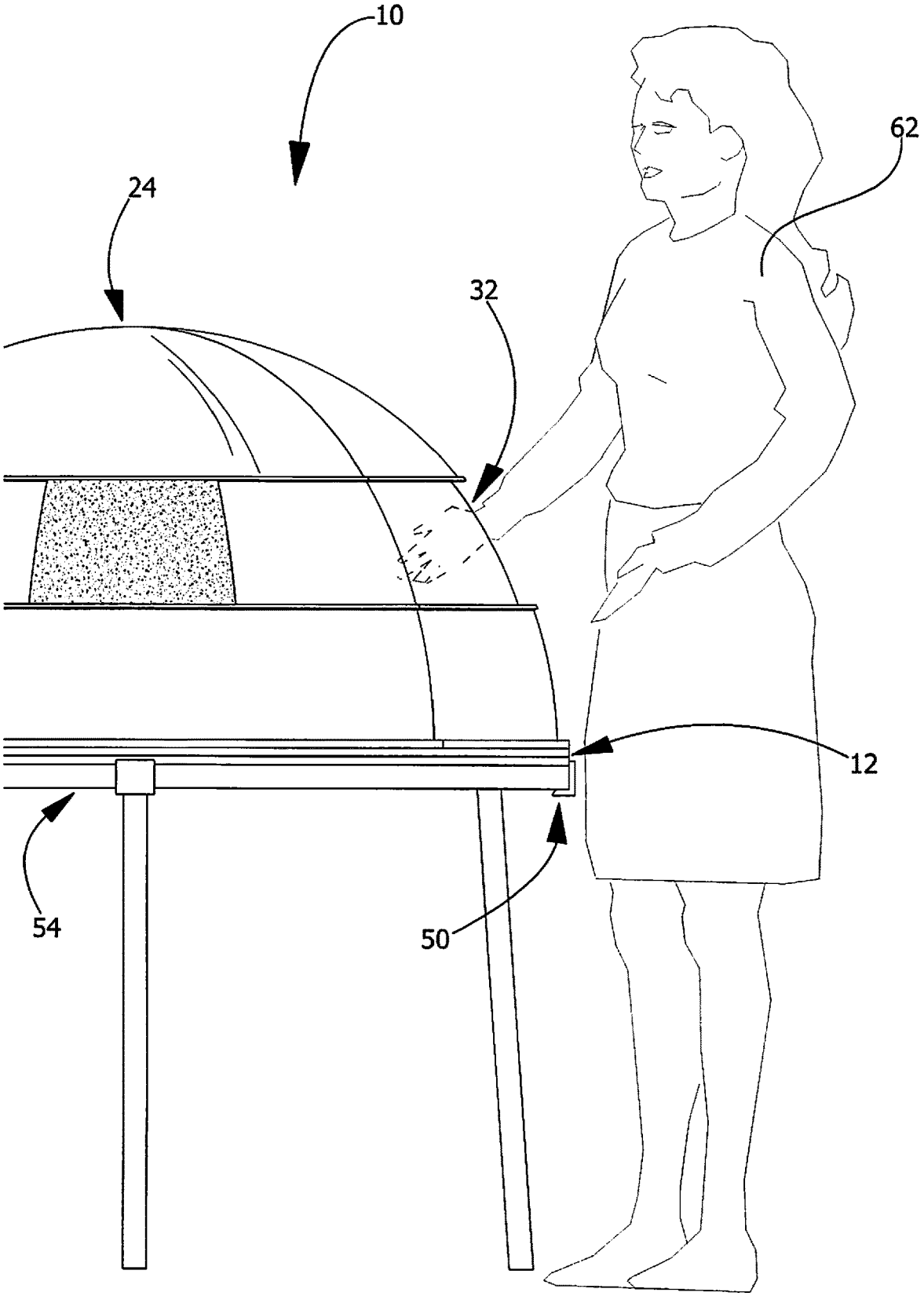
FIG. 6 is an in-use view of a user reaching through an access opening of a canopy of an embodiment of the disclosure.

With reference now to the drawings, and in particular to FIGS. 1 through 6 thereof, a new table cover embodying the principles and concepts of an embodiment of the disclosure and generally designated by the reference numeral 10 will be described.

As best illustrated in FIGS. 1 through 6, the table cover assembly 10 generally comprises a base 12 which is shaped and configured to be coextensive with an upper surface 56 of a tabletop 54 when the base 12 is positioned atop the tabletop 54. The base 12 and the tabletop 54 are circular but may be different shapes in other embodiments. The base 12 comprises a bottom member 14 and a top member 16. The top member 16 is rotatably mounted to and is coextensive with the bottom member 14 as in a turntable. The base 12 comprises ball bearings 18 positioned between the top member 16 and the bottom member 14 which facilitate rotation of the top member 16 with respect to the bottom member 14. The top member 16 comprises a central portion 20 and a lip portion 22 which surrounds the central portion 20. The lip portion 22 extends upwardly and outwardly with respect to the central portion 20.

A canopy 24 defines a cavity 26 and is removably positionable atop the base 12 in a covering position 30 wherein the base 12 covers an opening 28 to the cavity 26. The canopy 24 and the base 12 thereby enclose the cavity 26 when the canopy 24 is in the covering position 30. The canopy 24 defines a plurality of access openings 32 which extend through the canopy 24 to the cavity 26. The canopy 24 also has a break defining a pair of segments 34 of the canopy 24 which are equal in size and shape to each other. The segments 34 abut each other when the canopy 24 is positioned in the covering position 30. In some embodiments, fasteners such as snap connections, magnets, latches, or the like may selectively join the segments 34 together when the cavity 26 is in the covering position 30. The canopy 24 comprises a rigid material and has a dome shape. Each segment 34 then has a half dome shape, and the segments 34 may nest into each other for storage purposes. The canopy 24 may have other suitable shapes for defining the cavity 26 such as an ellipsoidal dome, a hollow polyhedron, or the like.

Each segment 34 of the canopy 24 also defines an air vent 36 configured for permitting air to flow through the segment 34 while preventing insects from passing therethrough. The air vents 36 comprise a plurality of through holes with widths small enough to prevent the insects from passing through into the cavity 26. It is understood that air vents 36 of some embodiments may not keep all insects from passing through and into the cavity 26. The through holes of the vents may be formed by meshed fibers, foam, or any other suitable material.

A plurality of doors 38 is mounted to the canopy 24. Each door 38 is movable to access the cavity 26 from outside the canopy 24 through at least one of the plurality of access openings 32 of the canopy 24. A track 40 is mounted to the canopy 24, and each door 38 is slidably coupled to the track 40. The track 40 extends around the canopy 24 across each segment 34 thereof. The track 40 is endless such that each door 38 may be selectively positioned over any of the access openings 32. The doors 38 may also pass between different segments 34 of the canopy 24 via the track 40, at least when the segments 34 are arranged to position the canopy 24 in the covering position 30. The track 40 comprises an upper rail 42 and a lower rail 44, and each door 38 is mounted between the upper rail 42 and the lower rail 44.

A closure 46 is provided for selectively securing the canopy 24 in the covering position 30 on the base 12. The closure 46 comprises a plurality of magnetic fasteners 48 which are coupled to the lip of the top member 16 of the base 12. When the canopy 24 is positioned in the covering position 30, the magnetic fasteners 48 magnetically engage a rim 29 of the canopy 24. In embodiments wherein the canopy 24 is comprised of a non-magnetic material, additional magnets or ferromagnetic members may be attached to the rim 29 to enable magnetic attachment. The closure 46 may have any suitable fastener such as a snap connection, a latch, a threaded fastener, or the like.

A table mount 50 is provided and is configured to couple the base 12 to the tabletop 54. The table mount 50 comprises a plurality of mounting clips 52 coupled to the base 12. Each mounting clip 52 is shaped such that it extends around a periphery 58 and an underside 60 of the tabletop 54 when the base 12 is positioned atop the tabletop 54. Each mounting clip 52 has an L-shape but may have any suitable shape to facilitate clipping the base 12 to the tabletop 54.

In use, the base 12 of the table cover assembly 10 is mounted to the tabletop 54. Food or other items may be placed on the central portion 20 of the top member 16 of the base 12. Then the canopy 24 may be placed in the covering position 30 and attached to the top member 16 of the base 12. The items may be accessed by opening one of the various doors 38 and reaching through the corresponding access opening 32. To access items near another access opening 32, the top member 16 and canopy 24 may be rotated atop the bottom member 14 to bring those items and the corresponding access opening 32 nearer to a user 62. Items may also be accessed by lifting the canopy 24 when necessary. The air vents 36 allow airflow into the cavity 26 without exposing food or other items to insects or other hazards.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A table cover assembly comprising:

a base;

a canopy defining a cavity, the canopy being removably positionable atop the base in a covering position wherein the base covers an opening to the cavity, the canopy defining a plurality of access openings which extend through the canopy to the cavity;

a plurality of doors mounted to the canopy, each door being movable to access the cavity from outside the canopy through at least one of the plurality of access openings of the canopy; and a track mounted to the canopy, each door of the plurality of doors being slidably coupled to the track.

2. The assembly of claim 1, wherein the base is shaped and configured to be coextensive with an upper surface of a tabletop when the base is positioned atop the tabletop.

3. The assembly of claim 1, wherein the base comprises a bottom member and a top member, the top member being rotatably mounted to the bottom member, the top member being coextensive with the bottom member.

4. The assembly of claim 3, wherein the base comprises ball bearings positioned between the top member and the bottom member which facilitate rotation of the top member with respect to the bottom member.

5. The assembly of claim 3, wherein the top member comprising a central portion and a lip portion, the lip portion surrounding the central portion, the lip portion extending upwardly and outwardly with respect to the central portion.

6. The assembly of claim 1, wherein the canopy has a break defining a pair of segments of the canopy.

7. The assembly of claim 6, the track extending around the canopy across each segment of the pair of segments, each door being movable between the segments via the track.

8. The assembly of claim 7, wherein the track is endless such that each door is selectively positionable over any of the plurality of access openings.

9. The assembly of claim 6, wherein the segments are equal in size and shape to each other.

10. The assembly of claim 1, wherein the canopy comprises a rigid material.

11. The assembly of claim 1, wherein the canopy has a dome shape.

12. The assembly of claim 1, wherein the canopy defines an air vent configured for permitting air to flow through the segment while preventing insects from passing therethrough.

13. The assembly of claim 1, wherein the track extends around the canopy, the track being endless such that each door is selectively positionable over any of the plurality of access openings.

14. The assembly of claim 1, wherein the track comprises an upper rail and a lower rail, each door being mounted between the upper rail and the lower rail.

15. The assembly of claim 1, further comprising a closure for selectively securing the canopy in the covering position on the base.

16. The assembly of claim 15, wherein the closure comprises a plurality of magnetic fasteners coupled to the base, the plurality of magnetic fasteners being engageable with the canopy, the plurality of magnetic fasteners being distributed along the lip of the top member of the base, the plurality of magnetic fasteners being engageable to a rim of the canopy.

17. The assembly of claim 1, further comprising a table mount configured to couple the base to a tabletop.

18. The assembly of claim 17, wherein the table mount comprises a plurality of mounting clips coupled to the base, the plurality of mounting clips being configured to extend around a periphery and underside of the tabletop.

19. A table cover assembly comprising:

a base, the base being shaped and configured to be coextensive with an upper surface of a tabletop when the base is positioned atop the tabletop, the base comprising a bottom member and a top member, the top member being rotatably mounted to the bottom member, the top member being coextensive with the bottom member, the base comprising ball bearings positioned between the top member and the bottom member which facilitate rotation of the top member with respect to the bottom member, the top member comprising a central portion and a lip portion, the lip portion surrounding the central portion, the lip portion extending upwardly and outwardly with respect to the central portion;

a canopy defining a cavity, the canopy being removably positionable atop the base in a covering position wherein the base covers an opening to the cavity, the canopy defining a plurality of access openings which extend through the canopy to the cavity, the canopy having a break defining a pair of segments of the canopy, the segments being equal in size and shape to each other, the canopy comprising a rigid material, the canopy having a dome shape, each segment of the pair of segments defining an air vent configured for permitting air to flow through the segment while preventing insects from passing therethrough;

a plurality of doors mounted to the canopy, each door being movable to access the cavity from outside the canopy through at least one of the plurality of access openings of the canopy;

a track mounted to the canopy, each door of the plurality of doors being slidably coupled to the track, the track extending around the canopy across each segment of the pair of segments, each door being movable between the segments via the track, the track being endless such that each door is selectively positionable over any of the plurality of access openings, the track comprising an upper rail and a lower rail, each door being mounted between the upper rail and the lower rail;

a closure for selectively securing the canopy in the covering position on the base, the closure comprising a plurality of magnetic fasteners coupled to the base, the plurality of magnetic fasteners being engageable with the canopy, the plurality of magnetic fasteners being distributed along the lip of the top member of the base, the plurality of magnetic fasteners being engageable to a rim of the canopy; and a table mount configured to couple the base to the tabletop, the table mount comprising a plurality of mounting clips coupled to the base, the plurality of mounting clips being configured to extend around a periphery and underside of the tabletop.

* * * * *